United States Patent [19]

Cleve et al.

[11] Patent Number: 4,831,859

[45] Date of Patent: May 23, 1989

[54] EXTRUSION TOOL FOR PRODUCING A DRILL BIT BLANK

[75] Inventors: Peter Cleve, Essen; Alfons Lomberg, Bottrop, both of Fed. Rep. of Germany

[73] Assignee: Fried. Krupp Gesellschaft mit beschränkter Haftung, Essen, Fed. Rep. of Germany

[21] Appl. No.: 189,077

[22] Filed: May 2, 1988

[30] Foreign Application Priority Data

Apr. 30, 1987 [DE] Fed. Rep. of Germany ..... 3714479

[51] Int. Cl.[4] ..... B21C 25/04; B21C 23/14

[52] U.S. Cl. ..... 72/260; 72/264; 72/269

[58] Field of Search ..... 72/260, 264, 269, 259; 76/108 R, 108 T

[56] References Cited

U.S. PATENT DOCUMENTS

| | | | |
|---|---|---|---|
| 1,325,301 | 12/1919 | Levy | 72/260 |
| 2,422,994 | 6/1947 | Taylor | 76/108 R |
| 2,954,121 | 9/1960 | Benson | 72/260 |
| 3,186,210 | 6/1965 | Lesher et al. | 72/260 |
| 3,190,101 | 6/1965 | Caisley | 72/260 |
| 3,242,712 | 3/1966 | Dalton | 72/260 |
| 3,302,440 | 2/1967 | Seidel et al. | 72/259 |
| 3,363,469 | 8/1966 | Seidel | 72/269 |
| 4,059,031 | 11/1977 | Erdelyi | 72/264 |
| 4,779,440 | 10/1988 | Cleve et al. | 72/260 |

FOREIGN PATENT DOCUMENTS

| | | |
|---|---|---|
| 8530884 | 9/1986 | Fed. Rep. of Germany . |
| 8536805 | 10/1986 | Fed. Rep. of Germany . |

*Primary Examiner*—Robert L. Spruill

*Attorney, Agent, or Firm*—Spencer & Frank

[57] ABSTRACT

An extrusion tool for making a drill bit blank provided with an internal rinsing bore extending helically in a longitudinal direction of the drill bit blank, includes a nozzle having an inner wall defining a throughgoing axial bore through which a malleable material is passed in a direction of extrusion parallel to the tool axis. The axial bore forms an inlet portion and a mold chamber adjoining the inlet portion downstream thereof as viewed in the direction of extrusion. There is further provided a mandrel situated in the inlet portion; a resiliently deformable wire supported by the mandrel and projecting into the mold chamber; and a helical device provided on the inner wall in the mold chamber for twisting the malleable material as it passes through the mold chamber. There is further provided a clamping device having a tightened state for immobilizing the nozzle and the mandrel with respect to one another during extrusion operation. In the loosened state of the clamping device a positional adjustment of the nozzle with respect to the mandrel may be made.

13 Claims, 3 Drawing Sheets

EXTRUSION TOOL FOR PRODUCING A DRILL BIT BLANK

FIELD OF THE INVENTION

1. Field of the Invention

The present invention relates to an extrusion tool for producing a drill bit blank having at least one internal helical rinsing bore. The drill bit blank is formed by forcing a malleable material through the tool. The material is preferably a metal or a ceramic. The tool includes a nozzle defining an intake bore and a mold chamber with a mandrel disposed adjacent the intake region of the nozzle. The mandrel is provided with at least one elastically deformable wire which projects into the nozzle intake bore externally of the longitudinal axis thereof. The tool also includes a nozzle mount connected to and coaxially disposed around the nozzle. The inner wall of the nozzle defining the intake bore and the mold chamber includes at least one helical means for twisting the malleable material passing through the nozzle.

2. Discussion of the Prior Art

In a conventional extrusion tool described, for example, in German Utility Model Nos. 85 30 884, (pub. Sept. 25, 1986) and 85 36 805 (pub. Oct. 2, 1986), the inner wall of the nozzle has at least one helical projection which serves as a guide web and which extends in the longitudinal direction. This projection causes the material, which has been heated to the extrusion molding temperature, to be twisted while passing through the nozzle. Such twisting is independent of any external parameters that may influence the formation of the drill bit blank, for example, the flow rate of the material. The extended drill bit blank exiting from the nozzle thus has at least one groove disposed therein. The number of grooves corresponds to the number of projections on the inner wall of the nozzle. The groove or grooves are subsequently machined to obtain the eventual chip space in the finished drill bit. Since the material passing through the extrusion molding tool is in a malleable state, the twisted drill bit blank can be of any desired length by simply severing it after extrusion.

The mandrel of the extrusion tool is equipped with at least one wire made of an elastically deformable material. The number of wires attached to the mandrel determines the number of rinsing bores in the drill bit. The material of the wire is selected so that the wire will adapt itself in the region of the nozzle with the least possible resistance to the helical movement of the material These wires allow the formation of the helical rinsing bores in the processed material. Suitable elastically deformable wire materials include: copper, copper alloys, iron, iron alloys, composite metal alloys, light metals, and light metal alloys particularly those including aluminum. The use of certain plastics, such as polyamide, has been found to be advantageous as a coating for the metal wires.

The position of the rinsing bore relative to the groove can be adjusted by varying the respective positions of the wire and the projection at the inlet zone of the nozzle. For example, in an embodiment that produces a drill bit blank having two grooves and two internal rinsing bores, the angle formed between the respective connecting lines may be from 0° to 90°.

According to past experience, it has been found that the spiral angle of the helical projection in the nozzle should be slightly larger than the spiral angle desired for the drill bit blank. Generally, the angle of the projection should be overdimensioned between 3° and 7°.

The drawback of the prior art is that the mandrel, its accessories and the nozzle are accessible only after the extrusion molding tool has been disassembled from its associated supporting structure. This means that any fine adjustment or re-adjustment of the extrusion molding tool is complicated as well as time consuming.

SUMMARY OF THE INVENTION

It is an object of the present invention to produce an extrusion tool where the mutual association of the components which influence the configuration of the drill bit blank can be readily changed with a minimum of manipulations and such a change may be effected even during the extrusion process.

The above and other objects are accomplished by the invention according to which the extrusion tool has a nozzle having an inner wall defining a throughgoing axial bore through which a malleable material is passed in a direction of extrusion parallel to the tool axis. The axial bore forms an inlet portion and a mold chamber adjoining the inlet portion downstream thereof as viewed in the direction of extrusion. There is further provided a mandrel situated in the inlet portion; a resiliently deformable wire supported by the mandrel and projecting into the mold chamber; and a helical device provided on the inner wall in the mold chamber for twisting the malleable material as it passes through the mold chamber. There is further provided a clamping device having a tightened state for immobilizing the nozzle and the mandrel with respect to one another during extrusion operation. In the loosened state of the clamping device a positional adjustment of the nozzle with respect to the mandrel may be made.

It is thus the basic principle of the invention that the nozzle and the mandrel can be fixed in different positions relative to one another, that is, the nozzle and the mandrel can be displaced relative to one another and locked in the desired position. The extrusion tool is preferably configured so that the relative displacement between the mandrel and the nozzle is infinitely variable.

The positioning of the mandrel relative to the nozzle can be accomplished by various methods. One method involves the rotation of the mandrel relative to the nozzle about the longitudinal axis of the nozzle. The new position of the mandrel, relative to the drill bit blank being formed, is different from the previously assumed starting position. This rotary adjustment results in at least one interior rinsing bore assuming a different location within the drill bit blank, and specifically a different position with respect to an associated helical groove.

Another method of relative movement between the nozzle and the mandrel is accomplished by longitudinally displacing the nozzle relative to the mandrel. This can be done alone or in conjunction with the rotary displacement discussed above. Displacement of the nozzle and mandrel relative to one another in the longitudinal direction permits the position of the elastically deformable wire to change with respect to the longitudinal axis of the nozzle. Thus, for example, if the mandrel that is projecting into the intake region of the nozzle is moved slightly away from the mold chamber, the material would deform the wire to a greater extent toward the longitudinal axis of the nozzle than if the mandrel is in its starting position. As a result, in the drill bit blank the distance between the rinsing bore and the longitudinal axis is reduced. A longitudinal displacement of the mandrel in the opposite direction causes the distance between the rinsing bore and the longitudinal axis of the nozzle to increase. A particular combination of longitudinal displacement and rotary displacement can produce a drill bit blank where, additionally, the rinsing bore can be adapted to the outer configuration of the drill bit blank.

In a preferred embodiment of the present invention, a holding ring which supports the mandrel is releasably connected to the nozzle mount by a clamping ring. The clamping ring is rotatably supported on the nozzle mount. Unscrewing the clamping ring removes the locking engagement between the holding ring and the nozzle mount so that the mandrel and the nozzle can be rotated relative to one another. This adjustment between the mandrel and the nozzle can be accomplished without removing the connection between the extrusion tool and its supporting structure.

According to another feature of the invention, the nozzle is linearly movably supported in its mount. This is achieved by providing a longitudinal groove along the exterior surface of the nozzle and the groove is engaged by a projection—for example, a cylindrical pin—associated with the nozzle mount.

The nozzle is preferably held in the nozzle mount by a setting ring which has a supporting surface that contacts the nozzle adjacent one end of the mold chamber. The nozzle can be moved to and retained in different longitudinal positions with respect to the nozzle mount by adjustment of the setting ring. The latter is movable in the longitudinal direction of the nozzle mount and can be fixed in any desired longitudinal position by a suitable clamping element. However, it is also possible for the setting ring to have a threaded connection with the nozzle mount. In such a case the setting ring may also carry a fixing screw which can be clamped to the nozzle mount to fix the desired position. Rotation of the setting ring simultaneously causes the support surface to move in the longitudinal direction of the nozzle mount. This results also in a change of position of the nozzle with respect to the nozzle mount.

The nozzle and the inlet structure which precedes the nozzle and which has an inlet bore narrowing in the direction of material movement, may be in principle a multipart construction. Preferably, the inlet structure is affixed—releasably, if desired—to the nozzle.

In order to ensure that the malleable material completely fills the mold chamber immediately following the mandrel and externally of the region of the wire or wires, the mandrel is of conical shape in that zone of its frontal portion. The cone angle at the tip of the mandrel should be at least 90° and preferably about 120°.

Depending on the desired shape of the outer contour of the drill bit blank, the helical means for twisting the material may be configured as a groove or as a rib protruding towards the longitudinal axis of the nozzle.

By virtue of these alternatives, the drill bit blank may be provided either with a few grooves or projections which can serve as the starting point for making the chip spaces in the drill bit. However, the extrusion tool according to the invention may also be configured so that the inner wall of the nozzle is provided with a larger number of grooves which have a small cross section. These grooves ensure that the malleable material is twisted as it flows through the nozzle. After removal of the drill bit blank from the tool, the flat projections caused by the grooves may be removed in an inexpensive grinding process.

DESCRIPTION OF THE PREFERRED EMBODIMENTS

Figure 2:
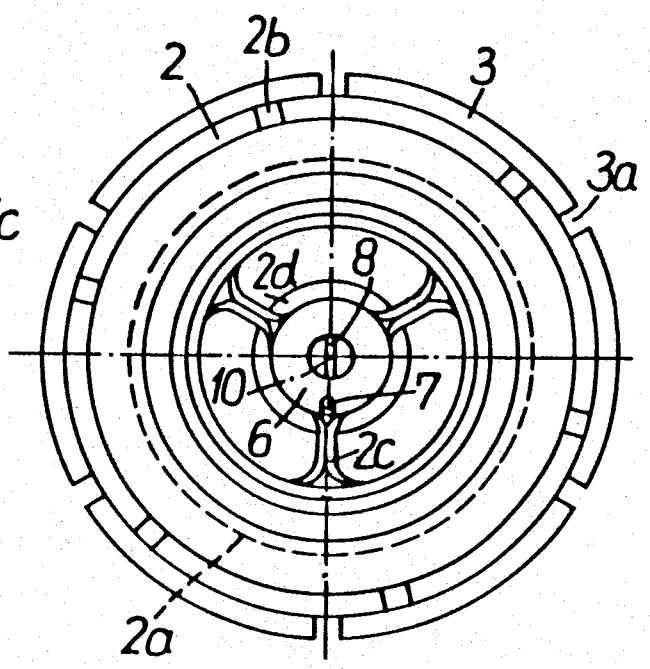
FIG. 2 is a rear elevational view of the preferred embodiment shown in FIG. 1.
Figure 1:
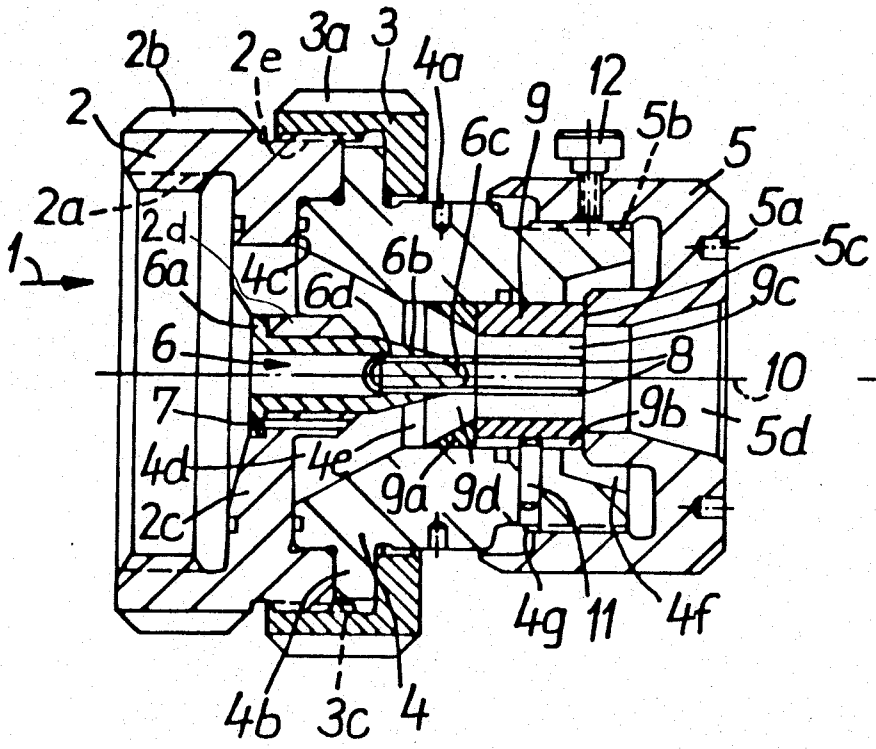
FIG. 1 is a sectional elevational view of an extrusion tool according to a preferred embodiment of the invention.

The extrusion tool according to the present invention is illustrated in FIG. 1. It includes the following major components as viewed in the direction of extrusion indicated by the arrow 1: a holding ring 2, a clamping ring 3, an essentially tubular nozzle mount 4 and a setting ring 5. The holding ring 2 has a threaded connecting bore 2*a* that allows the tool to be fastened to a supporting structure (not shown) which supplies the malleable material to the tool through holding ring 2. Holding ring 2 also includes externally disposed adjustment grooves 2*b*. The clamping ring 3 is provided with externally disposed adjustment grooves 3*a* and the nozzle mount 4 is provided with radially disposed adjustment bores 4*a*. The setting ring 5 includes adjustment bores 5*a* disposed on the frontal end face thereof.

Holding ring 2 is provided with three radially inwardly directed webs or arms 2*c* which connect to hub 2*d*. A mandrel 6 is releasably disposed in hub 2*d* by a cylindrical pin 7. The mandrel 6 is secured against longitudinal movement in the flow direction by a flange or step 6*a* which abuts hub 2*d*. Two wires 8 made of a resilient synthetic material or a metal coated by a synthetic material extend from the conical front section 6*b* of the mandrel 6. The wires 8 constitute the legs of a one-piece wire whose U-shape bend is located within mandrel 6. The properties of the synthetic material should be such that the wire opposes the deformation occurring during the extrusion process with the least possible deformation resistance and has the lowest possible friction resistance as it contacts the advancing material. The mandrel 6 has a cone shaped front terminus 6*c*. The wires 8 project forwardly beyond the terminus 6*c* which has a cone angle of 120°, while the conical front section 6*b* between the tip 6*c* of the cone and the cylindrical section of the mandrel 6 has the shape of an acute angled frustum. The two wires 8 are held in the mandrel 6 by two bores 6*d* and are fastened thereto by gluing.

The releasable connection between holding ring 2 and nozzle mount 4 is accomplished by the clamping ring 3 which abuts a flange 4*b* of the nozzle mount 4 and which is threadedly connected to the holding ring 2 by the cooperation between an inner thread 3*c* of the clamping ring 3 and an outer thread 2*e* of the holding ring 2. By rotating the clamping ring 3 in one direction, the holding ring 2 and nozzle mount 4 are rigidly clamped to one another against a sealing face 4c. By rotating the clamping ring 3 in the other, releasing direction, a relative rotation between the holding ring 2 and the nozzle mount 4 is possible.

Nozzle mount 4 includes a forwardly narrowing starting bore 4d at one end and a forwardly widening end bore 4f at the other. Between the starting bore 4d and the end bore 4f the nozzle mount 4 is provided with a cylindrical bore 4e. A nozzle 9 provided with an upstream inlet piece 9a is longitudinally movably disposed in the cylindrical bore 4e. The longitudinal axis of the nozzle, which coincides with the longitudinal axis of mandrel 6 is designated by reference numeral 10.

The linear guide means for the nozzle 9 and the inlet piece 9a affixed thereto includes a guide pin 11 which is connected to the nozzle mount 4 and which projects into a longitudinal groove 9b in the outer surface of the nozzle 9. The latter further has a generally cylindrical mold chamber 9c defined therein. The intake piece 9a has an intake bore 9d defined therein which tapers in the extrusion direction.

The relative position of nozzle 9 and intake piece 9a with respect to the nozzle mount 4 and the mandrel 6 can be set by means of the setting ring 5. The latter is provided with an inner thread 5b and the nozzle mount 4 is provided with an outer thread 4g. The threads 5b and 4g form a screw connection between nozzle mount 4 and setting ring 5 in the region of the end bore 4f. During the extrusion process, that end of the nozzle 9 which is remote from the mandrel 6 abuts a support face 5c of the setting ring 5. Rotation of the setting ring 5 causes movement of supporting face 5c either toward or away from mandrel 6. Once the desired position of the supporting face 5c (and thus nozzle 9) relative to the mandrel 6 is obtained, a fixing screw 12 can be tightened to clamp nozzle mount 4 and setting ring 5 together.

The setting ring 5 is also provided with a bore 5d which has a larger diameter than mold chamber 9c.

The relative position of nozzle 9 and intake piece 9a with respect to the conical sections 6b, 6c of mandrel 6 is significant since it determines the extent of deformation of the wires 8 toward the longitudinal axis 10 under the influence of the material being processed. The greater the distance of the cone shaped member 6c from the nozzle 9, the more the wires 8 are able to deform toward and thus reduce their distance from, the longitudinal axis 10 of the nozzle. Thus, the position of the rinsing bores 15 (see FIG. 5) produced by wires 8 can be varied steplessly and with great precision simply by rotating the setting ring 5.

Depending on the external shape of the drill bit blank desired, differently configured nozzles 9 may be utilized in the extrusion tool. Specifically the inner wall 9' which defines mold chamber 9c can be of different configuration to achieve the desired shape of the drill bit blank, as shown in FIGS. 3, 4, 6 and 7. The inner wall 9' has at least one helical component for twisting the advancing material. This twisting means is configured such that the advancing material is twisted by an angle of at least 90° and preferably by an angle of at least 180°.

Figure 3:
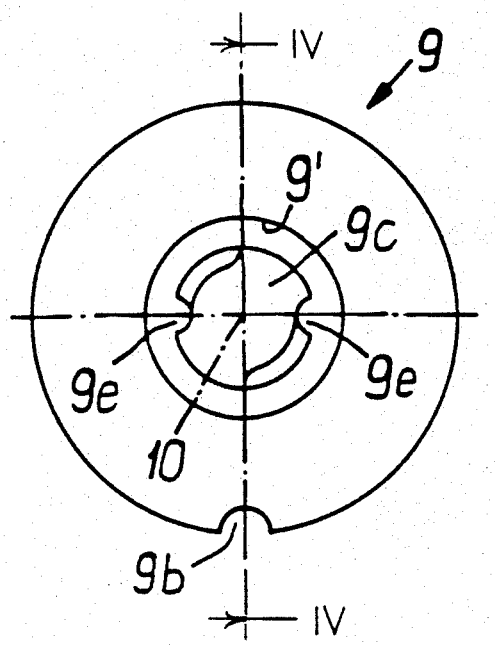
FIG. 3 is a front elevational view of a component of the preferred embodiment.
Figure 4:
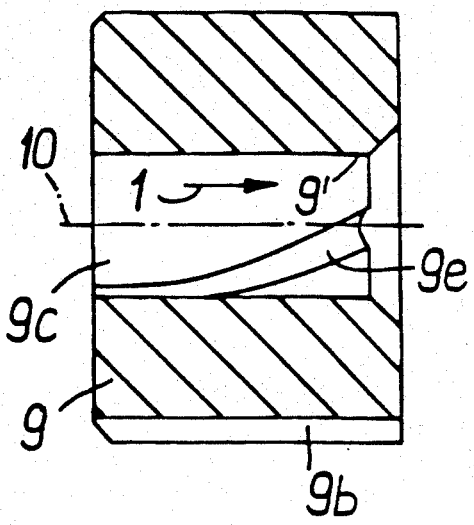
FIG. 4 is a sectional view taken along line IV—IV of FIG. 3.

According to the embodiment shown in FIGS. 3 and 4, nozzle 9 is equipped with two facing projections (ribs) 9e arranged diametrically opposite the longitudinal axis 10 of the nozzle 9. The ribs 9e project radially toward the longitudinal axis 10 and extend helically over an angle of 90°.

Figure 5:
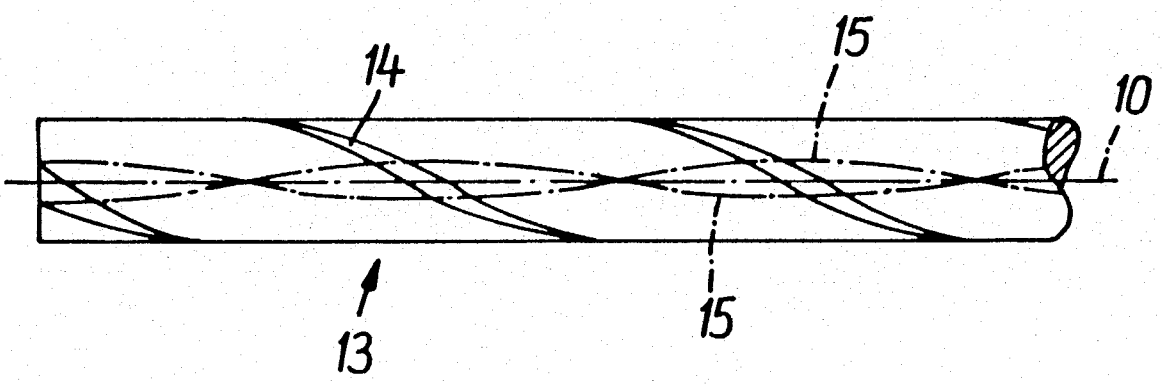
FIG. 5 is a side elevational view of a drill bit blank extruded by the tool of FIG. 1.

The drill bit blank 13 illustrated in FIG. 5 has one helical groove 14 and two internal rinsing bores 15. The rinsing bores 15 extend in an offset manner with respect to groove 14. The groove 14 was produced by a nozzle 9 which had only one projection that extended from the inner wall of the nozzle 9 (as opposed to FIGS. 3 and 4 which illustrate two projections.)

Figure 6:
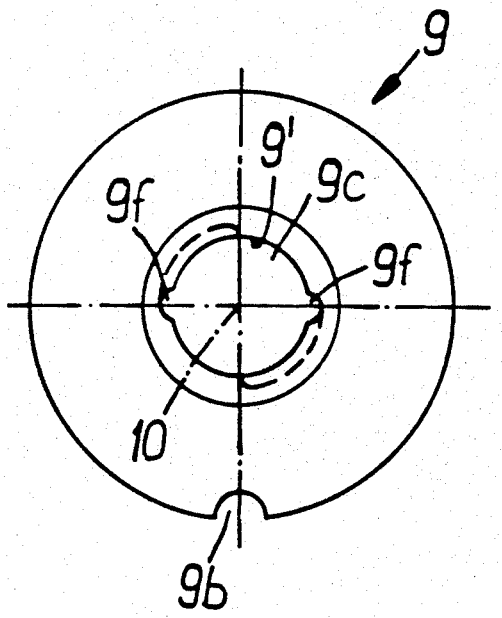
FIG. 6 is a front elevational view of a variant of the component of FIG. 3.

FIG. 6 illustrates another embodiment of nozzle 9. In this embodiment, nozzle 9 is provided with two grooves 9f in the inner wall 9' which delimit mold chamber 9c. These grooves face one another and are disposed diametrically relative to the longitudinal axis 10 of the nozzle 9. The grooves 9f have a semicircular cross section and extend over an angle of 90°.

The use of such a nozzle 9 results in the formation of a drill bit blank which has an outer surface contour that includes two helical ribs.

Figure 7:
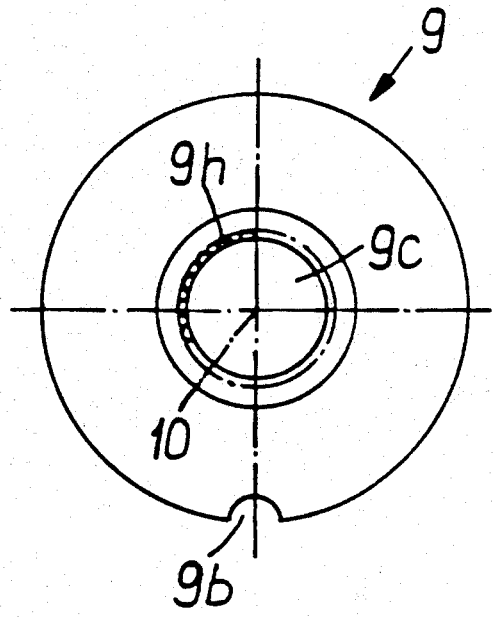
FIG. 7 is a front elevational view of another variant of the component of FIG. 3.

FIG. 7 illustrates a further embodiment of nozzle 9. In this embodiment, the inner wall of nozzle 9 is equipped with a plurality of grooves 9h located in close proximity to one another. These grooves have small cross sections and extend helically over an angular range of, for example, at least 90°. The width of one groove 9h may be, for example, in the order of magnitude of between 3 mm and 0.1 mm.

The advantage of the small-dimensioned grooves 9h is that they ensure sufficient twisting of the advancing material and the drill bit blank produced therefrom can be subsequently machined by simple grinding to obtain a smooth, cylindrical drill bit surface.

The position of the rinsing bore or bores 15 with respect to the groove 14 or rib of the drill bit blank can be varied in a simple manner. After loosening the clamping ring 3, the assembly formed of the nozzle mount 4, the nozzle 9 and the setting ring 5 can be rotated as a rigid unit through a desired angle with respect to the holding ring 2 for changing the position of the wires 8 relative to the nozzle 9.

The wires 8 fastened eccentrically to the mandrel 6 are so designed that they can be helically deformed without great resistance. This deformation corresponds to the twisting of the advancing malleable material in the nozzle and results in the formation of the interior rinsing bores 15.

The present disclosure relates to the subject matter disclosed in Federal Republic of Germany Application No. P 37 14 479.0 filed Apr. 30th, 1987, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. In an extrusion tool for making a drill bit blank having an internal rinsing bore extending helically in a longitudinal direction of the drill bit blank; the extrusion tool having a longitudinal axis;

a nozzle having an inner wall defining a throughgoing axial bore through which a malleable material is passed in a direction of extrusion parallel to said axis; said axial bore forming an inlet portion and a mold chamber adjoining said inlet portion downstream thereof as viewed in said direction of extrusion;

a mandrel situated in said inlet portion;

a resiliently deformable wire supported by the mandrel and extending along said axis and being spaced therefrom; said wire projecting into said mold chamber; and helical means provided on said inner wall in said mold chamber for twisting the malleable material as it passes through the mold chamber;

the improvement comprising clamping means having a tightened state for immobilizing said nozzle and said mandrel with respect to one another during extrusion operation of said extrusion tool; said clamping means further having a loosened state; and means for permitting a positional adjustment of said nozzle with respect to said mandrel in the loosened state of said clamping means.

2. An extrusion tool as defined in claim 1, wherein said means permitting a positional adjustment comprises mounting means for supporting said mandrel and said nozzle for rotation with respect to one another about said longitudinal axis.

3. An extrusion tool as defined in claim 1, wherein said means permitting a positional adjustment includes means for allowing an axial displacement of said nozzle and said mandrel with respect to one another.

4. An extrusion tool as defined in claim 1, wherein said helical means comprises a groove extending helically in said inner wall of said nozzle.

5. An extrusion tool as defined in claim 1, wherein said helical means comprises a rib-like projection extending helically in said inner wall of said nozzle.

6. An extrusion tool as defined in claim 1, wherein said helical means comprises a plurality of grooves extending helically in said inner wall of said nozzle.

7. An extrusion tool as defined in claim 6, wherein said grooves extend in an immediately adjoining relationship.

8. An extrusion tool as defined in claim 1, wherein said mandrel has a downstream portion from which said wire projects into said mold chamber; said downstream portion has a conical shape and has a downstream-oriented cone angle of at least 90°.

9. An extrusion tool as defined in claim 8, wherein said cone angle is 120°.

10. An extrusion tool as defined in claim 1, further comprising a nozzle mount receiving said nozzle therein; and a holding ring disposed axially adjacent said nozzle mount and supporting said mandrel therein; and further wherein said clamping means comprises a clamping ring surrounding said holding ring and said nozzle mount; said clamping ring including means for tightening said holding ring to said nozzle mount in said tightened state.

11. An extrusion tool as defined in claim 10, further comprising linear guide means for axially guiding said nozzle relative to said nozzle mount.

12. An extrusion tool as defined in claim 10, wherein said nozzle has an outlet end situated remote from said mandrel; further comprising a setting ring supported on said nozzle mount and having a support face abutting said outlet end of said nozzle for determining a forwardmost axial position thereof with respect to said nozzle mount;

means for tightening said setting ring to said nozzle mount, said setting ring and said means for tightening said setting ring forming part of said clamping means; and means for permitting an axial displacement of said setting ring on and relative to said nozzle mount to vary an axial position of said support face of said setting ring.

13. An extrusion tool as defined in claim 12, further comprising means for threadedly connecting said setting ring to said nozzle mount; said means for tightening said setting ring to said nozzle mount comprises a tightening screw carried by said setting ring and being arranged to be tightened against said nozzle mount.

* * * * *